United States Patent [19]

Stalder et al.

[11] Patent Number: 4,819,421

[45] Date of Patent: Apr. 11, 1989

[54] METHOD AND APPARATUS FOR MONITORING A PREDETERMINED YARN QUALITY AT A TEXTILE MACHINE, ESPECIALLY AT A FRICTION SPINNING APPARATUS

[75] Inventors: Herbert Stalder, Kollbrunn; Peter Egloff, Aadorf; Rolf Binder, Schottikon; Josef Baumgartner, Sirnach, all of Switzerland

[73] Assignee: Maschinenfabrik Rieter AG, Winterthur, Switzerland

[21] Appl. No.: 185,687

[22] Filed: Apr. 25, 1988

[30] Foreign Application Priority Data

Apr. 27, 1987 [CH] Switzerland ..... 01601/87

[51] Int. Cl.[4] ..... D01H 13/10; D01H 1/135

[52] U.S. Cl. ..... 57/264; 57/401

[58] Field of Search ..... 57/261, 263, 264, 400, 57/401, 93, 352

[56] References Cited

U.S. PATENT DOCUMENTS

| | | | |
|---|---|---|---|
| 4,007,457 | 2/1977 | Aeppli | 57/264 |
| 4,058,962 | 11/1977 | Spescha et al. | 57/265 |
| 4,489,544 | 12/1984 | Morita et al. | 57/264 XR |
| 4,566,262 | 1/1986 | Schumucker | 57/264 |
| 4,648,054 | 3/1987 | Farah et al. | 57/264 XR |
| 4,677,819 | 7/1987 | Stahlecker | 57/264 |
| 4,691,509 | 9/1987 | Stahlecker | 57/264 |

FOREIGN PATENT DOCUMENTS

| | | |
|---|---|---|
| 0148402 | 7/1985 | European Pat. Off. . |
| 0181105 | 5/1986 | European Pat. Off. . |
| 2525560 | 12/1976 | Fed. Rep. of Germany . |
| 3316657 | 11/1984 | Fed. Rep. of Germany . |
| 3424709 | 2/1986 | Fed. Rep. of Germany . |

*Primary Examiner*—Donald Watkins

*Attorney, Agent, or Firm*—Werner W. Kleeman

[57] ABSTRACT

To control the yarn quality of a yarn produced by a textile machine, for instance a friction spinning apparatus, there is provided at the end of the friction spinning operation, however, forwardly of the pair of withdrawal rolls for the outfeed of the produced yarn, a yarn tension measuring device. Upon deviating from or falling outside of a predeterminate yarn tension tolerance value or range the yarn tension measuring device controls operation of the friction spinning apparatus such that, as required, there is accomplished an appropriate increase or decrease of the yarn tension of the yarn produced by the friction spinning apparatus. Alteration of the yarn tension can be acheived, for instance, by acting upon the drive for one of the friction spinning elements, to control the rotational speed thereof, or by selectively positioning the suction nozzle of a friction spinning element, or by controlling the size of the nip between coacting friction spinning elements, or selected combinations of such measures.

36 Claims, 2 Drawing Sheets

METHOD AND APPARATUS FOR MONITORING A PREDETERMINED YARN QUALITY AT A TEXTILE MACHINE, ESPECIALLY AT A FRICTION SPINNING APPARATUS

CROSS-REFERENCE TO RELATED APPLICATION

This application is related to our commonly assigned, co-pending U.S Application Ser. No. 07,185,688 filed Apr. 25, 1988, and entitled "METHOD AND APPARATUS FOR MONITORING A PREDETERMINED YARN QUALITY AT A TEXTILE MACHINE, ESPECIALLY AT A FALSE-TWIST JET SPINNING APPARATUS".

BACKGROUND OF THE INVENTION

The present invention relates to a new and improved method for monitoring a predeterminate or predetermined yarn quality of a yarn or the like produced by a textile machine, especially a friction spinning apparatus, and further pertains to a new and improved friction spinning apparatus for performing the inventive method.

In the context of this disclosure, the term "yarn" or equivalent expressions, are used in their broader sense to encompass not only yarns as such, but also threads and other filamentary material.

In the production of yarn, the evenness of the yarn quality at each spinning position or location, as well as the comparative yarn quality between the individual spinning positions or locations, plays an important role.

German Published Patent Application No. 3,517,763 A1, published Nov. 20, 1986, discloses a method and an apparatus for maintaining a predetermined yarn twist to enable checking or controlling the evenness of this yarn quality parameter.

Direct measurement of yarn twist while the spinning process is in progress cannot be achieved. Accordingly, the yarn twist must be estimated with the aid of a yarn diameter measurement. This can be accomplished without contact between the yarn to be measured and the measuring device, i.e. can be measured only indirectly.

SUMMARY OF THE INVENTION

Therefore with the foregoing in mind it is a primary object of the present invention to provide a new and improved method and apparatus for reliably monitoring a predeterminate yarn quality in a manner which is not afflicted with the aforementioned shortcomings of the prior art constructions.

Another and more specific object of the present invention aims at providing a new and improved method and apparatus for monitoring a predeterminate yarn quality, particularly by measuring the yarn tension at a textile machine, and specifically a friction spinning apparatus, in a highly reliable and accurate fashion and, when necessary, undertaking appropriate corrective measures to ensure for uniformity of the produced yarn or the like.

Still a further significant object of the present invention aims at performing a direct measurement at the fabricated yarn formed from a fiber tube in order to obtain a highly reliable estimate of the yarn quality.

Now in order to implement these and still further objects of the present invention, which will become more readily apparent as the description proceeds, the method for monitoring a predeterminate yarn quality is manifested, among other things, by the features that a yarn is fabricated by means of a friction spinning apparatus. The fibers delivered to a friction spinning element, such as a suction friction spinning drum or suction friction spinning disc, of the friction spinning apparatus are formed into a fiber tube from which there is formed the friction spun yarn. There is measured the mechanical tension of the running yarn in order to ascertain the yarn quality. The measured value of the mechanical tension of the running yarn is compared with a predeterminate tension or tolerance value or range constituting a reference or set value. Upon deviating from or falling outside such predeterminate tension or tolerance value or range, in other words, upon exceeding or overshooting or falling below or undershooting such predeterminate tension or tolerance value or range, the friction spinning apparatus is acted upon so as to cause a corresponding tension change or alteration in the yarn, namely a tension increase or tension decrease of the produced yarn.

As alluded to above, the invention is not only concerned with the aforementioned method aspects, but also relates to a new and improved construction of a friction spinning apparatus for the performance of the inventive method. The friction spinning apparatus comprises friction spinning elements or means providing a friction spinning location or position for forming a fiber tube. The friction spinning elements can comprise a pair of coacting friction spinning drums or rolls or a friction spinning disc coacting with a conical or frusto-conical roller (herein generally simply conical roll or roller). The friction spinning location or position is defined by a suction zone or region provided at the outer surface of a suction friction spinning drum, also referred to as a perforated suction drum or simply suction drum, of the coacting pair of friction spinning drums or at the outer surface of the friction spinning disc which is subjected to the action of suction or vacuum. This suction zone or region is formed or established by a suction slot provided in a suction device, such as a suction nozzle. This suction nozzle bounds at the inner surface of the perforated suction drum or friction spinning disc, as the case may be. This inner surface is located opposite the aforementioned outer surface of such perforated suction drum or friction spinning disc. The suction nozzle sucks or draws air through the suction zone or region. The friction spinning drum or roll, also referred to as a counter-roll or drum, cooperating with the perforated spinning drum, or the conical roll or roller cooperating with the friction spinning disc each define a counter element. Each such counter element is arranged at a predeterminate distance from its therewith cooperating friction spinning element. In the case of the coacting pair of friction spinning drums the cooperating element is the perforated spinning drum, and in the case of the friction spinning disc and coacting conical roll or roller, the cooperating element is the friction spinning disc which is subjected to a suction or vacuum action. Following the spinning location or position, viewed in the direction of yarn travel of the running yarn, there is provided a yarn tension measuring device or unit which delivers a measuring or measurement signal indicative of the measured yarn tension. Additionally, there are provided means which alter the yarn tension. Such yarn tension altering means can, for instance, move the suction nozzle such that the suction slot thereof is either moved in the direction of rotation of the perforated spinning drum or the suction friction spinning disc or in the opposite direction.

A further possibility for altering the yarn tension is to control the rotational speed of one of the friction spinning elements, such as the perforated spinning drum or the suction friction spinning disc, as a function of the measured yarn tension. Still a further possibility for altering the yarn tension, is to control the size of the nip or gap between the coacting friction spinning elements. Obviously, selected combinations of each of such various techniques are also possible.

Also, display or indicator means for displaying the yarn tension can be provided on the basis of which the yarn tension can be altered by manually initiating the above described techniques, or else it is equally possible to provide control means to automatically operate the means for altering the yarn tension on the basis of the measured or measurement signal.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
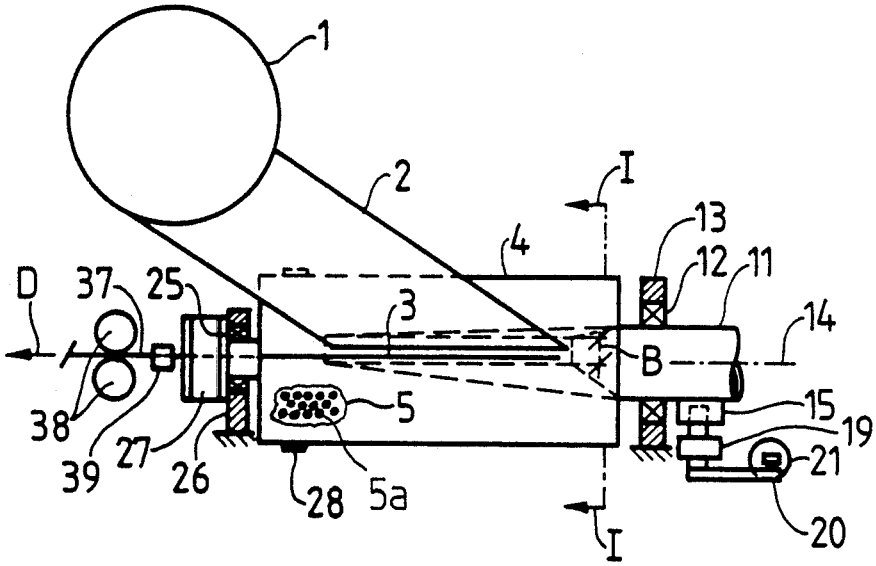
FIG. 1 illustrates part schematically a section of a friction spinning apparatus comprising a pair of coacting friction spinning elements, here shown as coacting friction spinning drums or rolls.

Describing now the drawings, it is to be understood that to simplify the showing thereof, only enough of the friction spinning apparatus, and the related structure or apparatus for monitoring a predeterminate yarn quality have been illustrated therein as are needed to enable one skilled in the art to readily understand the underlying principles and concepts of this invention. Turning now specifically to FIG. 1 of the drawings, the therein depicted exemplary embodiment of friction spinning apparatus comprises for instance, in known manner, an opening roller or roll 1 provided with an adjoining fiber transport passage or duct 2, the exit opening 3 of which is situated closely adjacent to a fiction spinning element, here shown as a suction drum 4 but without making contact with such suction drum 4 as also will be recognized by inspecting FIG. 3. As partly indicated at the region or location designated by reference numeral 5, the suction drum 4 constitutes a perforated suction drum which has a perforated region. Also, this suction drum or perforated suction drum 4 is provided in its interior with a suction nozzle 6 or equivalent suction generating device which is situated closely adjacent to the internal or inner wall 7 of the suction drum 4 without making contact therewith. With the aid of this suction nozzle 6, which is appropriately connected to a suitable conventional source of low pressure (not shown) as is well known in the friction spinning art, air is drawn or sucked through the fiber transport passage or duct 2 and through the perforations or holes 5*a* of the perforated region or location 5 of the perforated suction drum 4.

Figure 2:
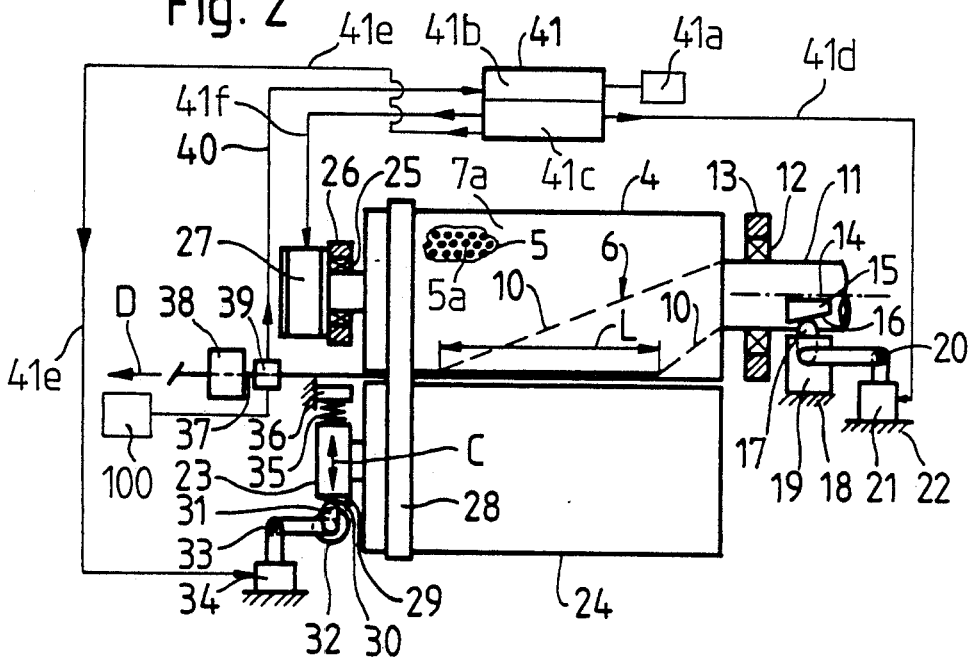
FIG. 2 illustrates a top plan view of the friction spinning apparatus depicted in FIG. 1 but with certain parts or elements omitted to improve clarity in the representation while adding other parts or elements in order to complete the understanding of the friction spinning apparatus depicted in FIG. 1.
Figure 3:
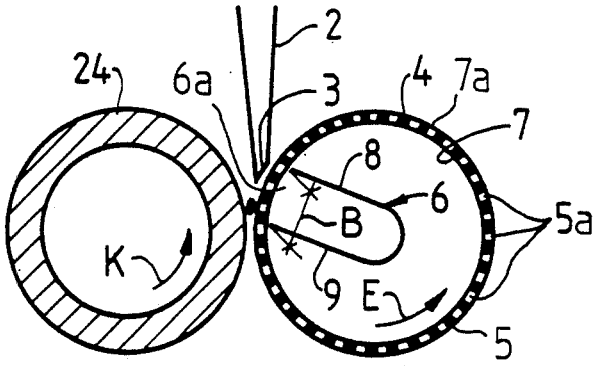
FIG. 3 illustrates on a somewhat enlarged scale and part schematically and in cross-sectional view the friction spinning apparatus of FIG. 1, taken substantially along the line I—I thereof.

As best seen by referring to FIGS. 2 and 3, the suction nozzle 6 comprises an upper wall 8 and a lower wall 9 as well as lateral closure walls 10 (indicated with dotted lines in FIG. 2). The suction nozzle 6 is also connected to a connector duct or tube 11 or equivalent structure.

The walls 8, 9 and 10 of the suction nozzle 6 define a suction slot or slit 6*a* which is adapted to the interior or inner wall 7 and having the width or breadth B (FIGS. 1 and 3) and the length L (FIG. 2).

The connector duct or tube 11 is rotatably supported in a rotary or rotational bearing 12, shown in a stationary housing portion 13, schematically illustrated in section in such FIGS. 1 and 2.

A guide element 15 is mounted on the connector duct or tube 11 for rotation of such connector duct or tube 11 in order to be able to appropriately pivot the suction nozzle 6 about the axis of rotation 14 of the connector duct or tube 11. This guide element 15 bears by means of a slide or ramp surface 16 forming part thereof on a cam or cam member 17 or equivalent structure. On the one hand, this cam or cam member 17 is pivotably supported in a pivot bearing or bearing structure 19 fixedly connected with a stationary housing part 18, schematically conveniently indicated only by the hatching, and, on the other hand, is pivotably connected by means of a link or rod 20 with an adjusting or positioning motor 21. This adjusting or positioning motor 21, in turn, is fixedly connected with a fixed housing portion 22. Such adjusting or positioning motors 21 are of known construction and can be, for example, constituted by an electromagnetic adjusting or positioning motor.

Instead of using for the friction spinning apparatus the perforated suction drum 4 and coacting counter-roll or drum 24, other types of cooperating friction spinning elements may be employed as previously indicated. For instance, as is known in the friction spinning art, there can be used an arrangement embodying an imperforate conical or frusto-conical roller coacting with a perforated disc to which suction is applied, as such an arrangement has been disclosed in British Patent No. 1,231,198, published May 12, 1971, as well as in the commonly assigned U.S. Pat. No. 4,660,371, granted Apr. 28, 1987, to which reference may be readily had.

At the end remote from the connector duct or tube 11, the perforated suction drum 4 is rotatably supported in a rotary or rotational bearing 25 fixedly mounted in a stationary housing part or portion 26.

The coacting friction spinning element, as above explained here shown as the imperforate counter-roll or drum 24 is arranged such that its lengthwise axis is substantially parallel to the lengthwise axis of the perforated suction drum or roll 4. In contrast to the construction of perforated suction drum 4, this counter-roll or drum 24 is, as stated, not a perforated roll or drum. Such counter-roll or drum 24 is rotatably supported in a rotary or rotational bearing 23. This rotary bearing 23 is guided for selective movement as a unit in the direction of the double-headed arrow C of FIG. 2 in a stationary slide mounting (not shown), but cannot be lifted off its guide structure.

The perforated suction drum or suction drum 4 is driven by a suitable drive motor 27 fixed to a housing portion or part 26.

The counter-roll or drum 24 is driven, for instance, by an elastic belt or belt member 28 or equivalent drive or power transmitting element stretched or trained around the perforated suction drum 4 and the counter-roll or drum 24 at any suitable location.

A guide element 29 is secured to the rotation or rotary bearing 23 in order to control the movements of the counter-roll or drum 24 in one or the other of the directions indicated by the double-headed arrow C. The guide element 29 bears by means of a slide or ramp surface 30 on a cam or cam member 31 or equivalent structure. This cam 31 is pivotably supported in a fixedly mounted rotary or rotational bearing 32 and is connected by means of a joint or hinge connection 33 with a stationary adjusting or positioning motor 34.

A compression or pressure spring 35 is fixedly arranged between the rotary bearing 23 and a fixed housing portion or part 36 on the side of the rotary bearing 23 which is located opposite the cam 31.

A yarn or thread 37 or the like spun by the friction spinning apparatus is withdrawn as a running or travelling yarn in the direction of the arrow D by a conventional withdrawal or delivery roller or roll pair 38.

A suitable yarn or thread tension measuring device 39 is provided before or upstream of the withdrawal or delivery roller pair 38 considered in the direction of yarn movement indicated by the arrow D. Such yarn or thread tension measuring devices 39 are known in the art, and one such suitable construction is commercially available, for example under the trade designation Electronic-Tensiometer R-1192 from the Swiss firm Rothschild Company of Traubenstrasse 3, CH-8002, Zurich, Switzerland.

A measurement signal defining an output signal appearing on the output line 40 of the yarn tension measuring device 39 and representative of the momentarily measured yarn tension is received by a suitable control unit or device 41. This control unit or device 41 is of conventional design and details thereof do not constitute subject matter of the present invention. Basically, the control unit 41 has a reference or set input or input section **41*a* at which there can be set a desired reference or set value of the yarn tension or tolerance value or range with which there is then compared in a comparator 41*b* the yarn tension measured by the yarn tension measuring device and on the basis of such comparison there is delivered at the output side or section 41*c* of the control device 41** an output signal which perfects a suitable control operation for either increasing or decreasing the yarn tension as the need dictates and as will be described more fully hereinafter. Control units or devices suitable for such purposes are well known in the electrical and electronic arts as well as in the textile art. An example of a suitable control device which can be utilized in the arrangement of the present invention has been disclosed, by way of example and not limitation, in U.S. Pat. No. 4,275,483, granted June 30, 1981, to which reference may be readily had and the disclosure of which is incorporated herein by reference.

In operation, a not particularly depicted fiber sliver or other appropriate fiber arrangement is fed into the opening roll 1 and conventionally separated at that location into individual fibers. These separated individual fibers are transported by means of the transport passage or duct 2 onto the surface of the perforated suction drum or roll 4. This procedure will be described in further detail with such fiber feed process is well known in the friction spinning art.

Figure 3A:
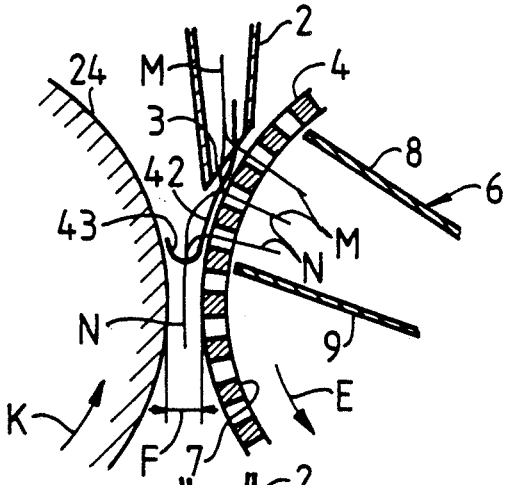
FIGS. 3A and 3B illustrate respective enlarged details of the arrangement of FIG. 3.
Figure 3B:
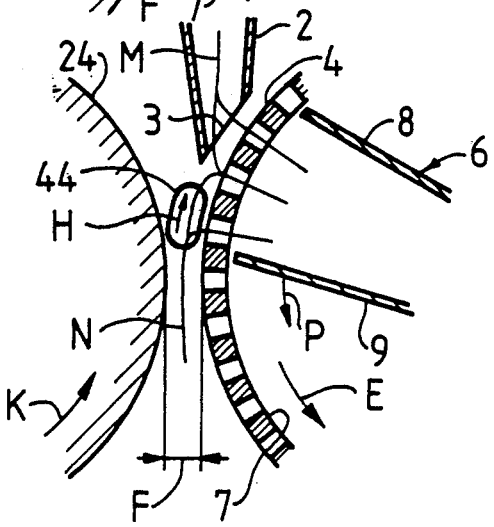

The airstream issuing from the fiber transport passage or duct 2 is indicated by the arrow M in FIGS. 3A and 3B and the airstream flowing through the narrowest gap or nip F is indicated by the arrow N in such FIGS. 3A and 3B. These two airstreams are induced by the suction effect of the suction nozzle 6 prevailing along the width or breadth B and length L of this suction nozzle 6.

As will be observed by referring to FIG. 3A, a fiber 42 deposited by the airstream M on the outer surface **7*a* of the suction drum 4 is transported on this drum surface 7*a*, as dictated by the direction of rotation E of the perforated suction drum 4 (FIG. 3) towards the narrowest gap or nip F until the leading fiber end 43 (FIG. 3A) is bent or curved by the lower or upwardly flowing airstream N and returned to such outer drum surface 7*a*** in order to be transported once again in the direction of the arrow E.

If this procedure is imagined not only for a single fiber 42 but for all of the delivered fibers, then it will be seen that a so-called fiber tube 44 is produced by this circulation or motion of the fibers. Due to the rotation direction indicated by the arrow E of the perforated suction drum 4 and the direction of rotation indicated by the arrow K of the counter-roll or drum 24, the produced fiber tube 44 rotates with a direction of rotation H (FIG. 3B) and with a peripheral speed essentially corresponding to the peripheral speed of the drums or rolls 4 and 24 i.e. practically without any slip. The yarn 37 thus produced condenses or constricts, in the direction of yarn movement indicated by the arrow D, from this fiber tube 44.

This procedure has been described in the German Published Patent Application No. 2,919,316, published Nov. 22, 1979 and to which reference may be readily had and the disclosure of which is incorporated herein by reference.

Now, if the suction nozzle 6 is shifted in the direction of rotation indicated by the arrow P (FIG. 3B), then the fiber tube 44 also moves in the same direction and becomes smaller in its cross-section and reaches a maximum reduction in its cross-section or cross-sectional area at the region of the narrowest gap or nip F. It has now been found that a higher thread tension and a higher twist level arise in the yarn 37 by virtue of this decrease in the yarn cross-section and as a result of the reinforced or augmented wedging effect of the fiber tube 44 located in the converging gap or nip F between the two coacting drums or rolls 4 and 24. As concerns the formed yarn 37, the aforementioned observations particularly apply to the yarn portion located before or upstream of the withdrawal or delivery roller or roll pair 38 considered in the direction of yarn movement indicated by the arrow D.

The suction nozzle 6 can be selectively positioned by the control unit or device 41 which delivers at the output line **41*d* a suitable control signal, as dictated by the aforementioned operation of the yarn tension measuring device 38 which, as stated, inputs the momentarily measured yarn tension at the line or conductor 40 to the control unit 41. The delivered control or output signal appearing on the line 41*d* is fed to the adjusting or position motor 20 which acts via the cam 17 and slide surface 16 upon the guide element 15 and thus upon the connector duct or tube 11 in order to appropriately pivot or move the suction nozzle 6 in one or the other directions of pivotal movement thereof. The restoring moment or torque of the suction nozzle 6 and connector duct or tube 11 maintains the slide surface 16 of the guide element 15 in contact with the cam 17**, but additionally or alternatively, there also could be provided for this purpose a suitable biasing element, such as a spring.

A further parameter or variable for adjusting tension in the yarn 37 is adjustment of the narrowest gap or nip F. As the gap or nip F becomes smaller, the cross-section of the fiber tube 44 also decreases and thus the yarn tension in the yarn 37 is increased.

Adjustment of the size of the gap or nip F can be accomplished in comparable fashion by the control unit or device 41 delivering at the output line 41*e* a suitable control signal which acts upon the adjusting or adjustment motor 34 so as to appropriately radially move the counter-roll or drum 24 through the action of the cam 31 upon the rotary bearing 23.

A further possibility for controlling the tension of the yarn 37 is afforded when the control unit or device 41 delivers at the output line 41*f* a control signal which acts upon the drive motor 27 in order to control the rotational speed of the perforated spinning drum or roll 4.

The control unit or device 41 determines whether the momentarily measured yarn tension (which also can be designated as thread tension) lies within a predetermined tolerance range or tension tolerance and, if this is not the case, causes in the aforedescribed manner a change in the width of the gap or nip F within a predetermined tolerance range or tolerance and/or pivoting of the suction nozzle 6 within a predetermined tolerance range or tolerance so as to again establish the desired or required yarn tension. Also, as above explained, modification of the yarn tension can be undertaken by controlling the rotational speed of the perforated spinning drum or roll 4.

The magnitude of the change in the width of the gap or nip F including the tolerance range therefor, and/or the magnitude of the pivotal movement of the suction nozzle 6, including the tolerance range therefor, must be determined empirically in dependence upon the design of the friction spinning apparatus. As to the design of the friction spinning apparatus, there should be taken into account for such control adjustment, among other things, for example, the diameter of the drums or rolls 4 and 24, the surface roughness of these drums or rolls 4 and 24, the quantity of air drawn in by the suction operation and so forth.

As to the choice between performance or sequence of performance of the three abovementioned possible operational steps, if two or three of these operational steps are combined, such must be determined empirically; for example, the position of the suction nozzle 6 may be adjusted first and thereafter the width of the gap or nip F.

If the yarn tension falls below the tension tolerance or tolerance range, then the width of the nip of gap F is reduced and/or the suction nozzle 6 is shifted in the direction of movement indicated by the arrow E in FIG. 3A. Conversely, if the yarn tension increases above the tension tolerance or tolerance range, then the two previously mentioned steps are carried out in the reverse sequence.

By way of completeness, it is here mentioned that the yarn tension measured by the yarn tension measuring device 39 can be appropriately indicated at a suitable display or indicator device 100 (FIG. 2) and on the basis of which the yarn tension then can be altered by manually initiating the aforedescribed yarn tension correction measures.

The control unit 41 shown for the friction spinning apparatus of FIGS. 1 to 3B is designed as an individual unit for each so-called spinning position or location (a plurality of spinning positions make up a spinning machine). It will be clear, however, that a solution of this type is expensive and is not absolutely necessary in view of the tension variations which occur slowly as a rule.

It is therefore known from the rotor open-end spinning technique that so-called travelling devices or robots carry out checking and operating functions on respective spinning units, so that an optimalization can be achieved as regards costs and frequency of the operations to be performed per spinning position or location.

It is therefore clear and should be so understood that a range of modifications can be provided in connection with travelling devices or robots, for example, all adjusting or positioning motors or the like required for adjusting the elements can be provided per spinning position, and only the yarn tension measuring equipment and control is allocated to the travelling device or robot; this represents the simplest solution mechanically.

As another variant, a travelling device or robot can measure the yarn tension and indicate it by display means, such as the aforedescribed display or indicator device 100, and the elements to be adjusted in order to change the tension are operated manually until the tension again lies in the given tolerance range.

A further application of the yarn tension measurement lies in the simple monitoring of the spinning position or location by means of the yarn tension measuring step or operation, i.e. that none of the aforedescribed measures to adjust the yarn tension are carried out, and on the basis of the given yarn tension tolerances a decision is made to stop the spinning unit in order to deal with the corresponding defect.

It will therefore be clear that the inventive concept of using the yarn tension to maintain the spinning apparatus on a yarn quality level corresponding to the desired yarn quality, is not limited to the illustrated and described examples.

While there are shown and described present preferred embodiments of the invention, it is to be distinctly understood that the invention is not limited thereto, but may be otherwise variously embodied and practiced within the scope of the following claims.

ACCORDINGLY,

What we claim is:

1. A method for monitoring a predeterminate yarn quality of a yarn spun by a friction spinning apparatus, comprising the steps of:

delivering fibers to a friction spinning element moving at a predeterminate speed;

forming at the friction spinning element a fiber tube from which the yarn is produced;

the fiber tube constituting a rotating fiber tube rotating practically without slip in relation to the predeterminate speed of movement of the friction spinning element;

forming a spun yarn from the fiber tube;
delivering the spun yarn as a running yarn;
measuring the mechanical tension of the running yarn to obtain a measured value of such measured mechanical tension in order to determine the quality of the spun yarn; and
upon deviation of the determined quality of the spun yarn controlling operation of the friction spinning apparatus so as to establish a predeterminate desired tension of the running yarn.

2. A method for monitoring a predeterminate yarn quality of a yarn spun by a friction spinning apparatus, comprising the steps of:
delivering fibers to a friction spinning element;
forming at the friction spinning element a fiber tube from which the yarn is formed;
forming a spun yarn from the fiber tube;
delivering the spun yarn as a running yarn;
measuring the mechanical tension of the running yarn formed from the fiber tube to obtain a measured value of such measured mechanical tension in order to determine the quality of the running yarn;
comparing the measured value with a predeterminate reference value defining a predeterminate tension tolerance for the yarn tension;
determining by said comparison any deviation of the measured value from the predeterminate tension tolerance; and
upon detection of a deviation of the measured value from the predeterminate tension tolerance controlling operation of the friction spinning apparatus to affect the tension of the running yarn so as to control the quality of the spun yarn.

3. The method as defined in claim 2, further including the step of:
using as the friction spinning element a friction spinning drum structured to form the fiber tube.

4. The method as defined in claim 2, further including the step of:
using as the friction spinning element a perforated suction drum.

5. The method as defined in claim 1, further including the step of:
continuously monitoring the yarn tension of the running yarn.

6. The method as defined in claim 5, further including the step of:
immediately after falling below the predeterminate tension tolerance acting upon the friction spinning apparatus so as to increase the tension of the running yarn.

7. The method as defined in claim 5, further including the step of:
after falling below the predeterminate tension tolerance stopping the operation of the friction spinning apparatus until such time as the friction spinning apparatus can be acted upon so as to increase the tension of the running yarn.

8. The method as defined in claim 5, further including the steps of:
after falling below the predeterminate tension tolerance acting upon the friction spinning apparatus such as to increase the tension of the running yarn formed from the fiber tube; and
if after acting upon the friction spinning apparatus the action is unsuccessful then stopping the friction spinning apparatus in order to correct defect in operation of the friction spinning apparatus.

9. The method as defined in claim 5, further including the step of:
immediately after exceeding the predeterminate tension tolerance acting upon the friction spinning apparatus so as to decrease the tension of the running yarn.

10. The method as defined in claim 5, further including the step of:
after exceeding the predeterminate tension tolerance stopping the operation of the friction spinning apparatus until such time as the friction spinning apparatus can be acted upon so as to decrease the tension of the running yarn.

11. The method as defined in claim 5, further including the steps of:
after exceeding the predeterminate tension acting upon the friction spinning apparatus such as to decrease the tension of the running yarn formed from the fiber tube; and
if after acting upon the friction spinning apparatus such action is unsuccessful then stopping the friction spinning apparatus in order to correct defect in operation of the friction spinning apparatus.

12. The method as defined in claim 2, further including the step of:
intermittently monitoring the yarn tension of the running yarn.

13. The method as defined in claim 12, further including the step of:
immediately after falling below the predeterminate tension tolerance acting upon the friction spinning apparatus so as to increase the tension of the running yarn.

14. The method as defined in claim 12, further including the step of:
after falling below the predeterminate tension tolerance stopping the operation of the friction spinning apparatus until such time as the friction spinning apparatus can be acted upon so as to increase the tension of the running yarn.

15. The method as defined in claim 12, further including the steps of:
after falling below the predeterminate tension tolerance acting upon the friction spinning apparatus such as to increase the tension of the running yarn formed from the fiber tube; and
if after acting upon the friction spinning apparatus such action is unsuccessful then stopping the friction spinning apparatus in order to correct defect in operation of the friction spinning apparatus.

16. The method as defined in claim 12, further including the step of:
immediately after exceeding the predeterminate tension tolerance acting upon the friction spinning apparatus so as to decrease the tension of the running yarn.

17. The method as defined in claim 12, further including the step of:
after exceeding the predeterminate tension tolerance stopping the operation of the friction spinning apparatus until such time as the friction spinning apparatus can be acted upon so as to decrease the tension of the running yarn.

18. The method as defined in claim 12, further including the steps of:
after exceeding the predeterminate tension tolerance acting upon the friction spinning apparatus such as to decrease the tension of the running yarn formed from the fiber tube; and if after acting upon the friction spinning apparatus the action is unsuccessful then stopping the friction spinning apparatus in order to correct defect in operation of the friction spinning apparatus.

19. The method as defined in claim 2, further including the steps of:

utilizing a pair of spaced and coacting friction spinning elements, only one of which is a perforated friction spinning element, for forming the fiber tube from which the yarn is produced; and upon falling below the predeterminate tension tolerance reducing the spacing between the pair of spaced and coacting friction spinning elements.

20. The method as defined in claim 2, further including the steps of:

utilizing a movable suction nozzle coacting with the friction spinning element; and upon falling below the predeterminate tension tolerance altering the position of the movable suction nozzle with respect to the friction spinning element in order to increase the tension of the running yarn.

21. The method as defined in claim 2, further including the steps of:

utilizing a pair of spaced and coacting friction spinning elements for forming the fiber tube from which the yarn is produced;

utilizing a movable suction nozzle coacting with one of the friction spinning elements; and upon falling below the predeterminate tension tolerance reducing the spacing between the pair of spaced and coacting friction spinning elements and altering the position of the movable suction nozzle with respect to the one friction spinning element such as to increase the tension of the running yarn.

22. The method as defined in claim 2, further including the steps of:

utilizing a pair of spaced and coacting friction spinning elements, only one of which is a perforated friction spinning element, for forming the fiber tube from which the yarn is produced; and upon exceeding the predeterminate tension tolerance increasing the spacing between the pair of spaced and coacting friction spinning elements.

23. The method as defined in claim 2, further including the steps of:

utilizing a movable suction nozzle coacting with the friction spinning element; and upon exceeding the predeterminate tension tolerance altering the position of the movable suction nozzle with respect to the friction spinning element in order to decrease the tension of the running yarn.

24. The method as defined in claim 2, further including the steps of:

utilizing a pair of spaced and coacting friction spinning elements for forming the fiber tube from which the yarn is produced;

utilizing a movable suction nozzle coacting with one of the friction spinning elements; and upon exceeding the predeterminate tension tolerance increasing the spacing between the pair of spaced and coacting friction spinning elements and altering the position of the movable suction nozzle with respect to the one friction spinning element such as to decrease the tension of the running yarn.

25. A friction spinning apparatus for producing a yarn and monitoring a predeterminate yarn quality of a yarn spun by the friction spinning apparatus, comprising:

means defining a spinning position and including at least one friction spinning element having an external surface and an internal surface and serving to produce a fiber tube from fibers delivered to the spinning position;

said means defining a spinning position including a suction zone provided on the external surface of the at least one friction spinning element;

said suction zone comprising a suction nozzle provided with a suction slot located adjoining the internal surface of the at least one friction spinning element;

said internal surface being located opposite said external surface of said at least one friction spinning element;

said means defining said spinning position further including a counter element cooperating with said at least one friction spinning element;

said counter element and said at least one friction spinning element being arranged in spaced relationship from one another to define therebetween a predeterminate nip between said counter element and said at least one friction spinning element:

a yarn tension measuring device arranged downstream of the spinning position with respect to a predeterminate direction of movement of spun yarn formed from the fiber tube; and means for adjusting tension of the spun yarn by selectively acting upon at least any one of said at least one friction spinning element, said counter element and said suction nozzle.

26. The friction spinning apparatus as defined in claim 25, wherein:

said at least one friction spinning element comprises a friction spinning drum.

27. The friction spinning apparatus as defined in claim 26, wherein:

said friction spinning drum comprises a perforated suction drum.

28. The friction spinning apparatus as defined in claim 27, wherein:

said counter element comprises an imperforate counter roll.

29. The friction spinning apparatus as defined in claim 25, further including:

display means for displaying the yarn tension as represented by a measurement signal generated by the yarn tension measuring device.

30. The friction spinning apparatus as defined in claim 29, wherein:

the means for adjusting the yarn tension is manually operable on the basis of the yarn tension displayed by the display means.

31. The friction spinning apparatus as defined in claim 25, further including:

control means for operating the means for adjusting the yarn tension automatically on the basis of a measurement signal generated by the yarn tension measuring device.

32. The friction spinning apparatus as defined in claim 25, wherein:

said means for adjusting the tension of the spun yarn selectively moves either the at least one friction spinning element or the counter element such that the spacing between the at least one friction spinning element and the counter element is adjustable.

33. The friction spinning apparatus as defined in claim 25, wherein:

said means for adjusting tension of the spun yarn controls rotational speed of at least one of the elements defining the spinning position.

34. The friction spinning apparatus as defined in claim 33, wherein:

said tension adjusting means controls the rotational speed of the at least one friction spinning element.

35. The friction spinning apparatus as defined in claim 25, further including:

a yarn tension measuring device provided for each spinning position.

36. The friction spinning apparatus as defined in claim 25, wherein:

said yarn tension measuring device constitutes a mobile structure selectively movable between a plurality of spinning positions.

* * * * *

UNITED STATES PATENT AND TRADEMARK OFFICE

CERTIFICATE OF CORRECTION

PATENT NO. : 4,819,421

DATED : April 11, 1989

INVENTOR(S) : HERBERT STALDER et al

It is certified that error appears in the above-identified patent and that said Letters Patent is hereby corrected as shown below:

Column 4, line 22, after "in" (second occurrence) please insert --sectional view in Figures 1 and 2, which is fixedly secured in--

Column 6, line 5, after "with" please insert --reference to Figures 3A and 3B, although it is remarked that--

Signed and Sealed this

Twenty-eighth Day of November 1989

*Attest:*

JEFFREY M. SAMUELS

*Attesting Officer*

*Acting Commissioner of Patents and Trademarks*